United States Patent [19]

Bower et al.

[11] Patent Number: 4,523,700

[45] Date of Patent: Jun. 18, 1985

[54] LOW FLOW CONTROL NOZZLE

[75] Inventors: Allen M. Bower, Erie; Gary L. Weeks, West Springfield, both of Pa.

[73] Assignee: Emco Wheaton, Inc., Conneaut, Ohio

[21] Appl. No.: 325,296

[22] Filed: Nov. 27, 1981

[51] Int. Cl.[3] ..... B67D 5/04

[52] U.S. Cl. ..... 222/505; 222/515; 251/228; 251/298

[58] Field of Search ..... 251/298, 299, 228; 222/509, 505, 515, 501

[56] References Cited

U.S. PATENT DOCUMENTS

| | | | |
|---|---|---|---|
| 1,850,063 | 3/1932 | Pepper | 222/505 X |
| 2,314,553 | 3/1943 | Palm | 251/228 X |
| 2,622,435 | 12/1952 | Lucas et al. | 251/228 X |
| 3,005,476 | 10/1961 | Klaus | 222/52 X |
| 3,062,247 | 11/1962 | Botkin | 141/94 X |
| 3,988,001 | 10/1976 | Kankaras | 251/228 X |

*Primary Examiner*—Joseph J. Rolla
*Assistant Examiner*—Kevin P. Shaver
*Attorney, Agent, or Firm*—Pearne, Gordon, Sessions, McCoy, Granger & Tilberry

[57] ABSTRACT

A hand-operated dispensing nozzle control valve particularly suited for metered delivery of fuel. The control valve includes a poppet and actuator to initially tilt the poppet on its seat. The actuator arrangement greatly improves controllability as measured by a substantial decrease in required operating force and a reduction in the minimum quantity of liquid which can be dispensed.

2 Claims, 11 Drawing Figures

LOW FLOW CONTROL NOZZLE

BACKGROUND OF THE INVENTION

This invention relates to nozzles for dispensing fuels such as gasoline which have easier operation and more accurate control of the amount of fuel being dispensed.

Hand-operated fuel dispensing nozzles are widely used in service stations in the transfer of fuel into the tank of a vehicle such as an automobile. In order to achieve high delivery flow rates, fluid pressure in the delivery circuit is usually maintained at a relatively high level and this requires relatively high manual effort for actuation of the dispensing nozzle. An additional problem often encountered by a person operating such a dispensing nozzle is a variation in pressure which occurs between the open and closed conditions of the dispensing valve accompanied by a corresponding fluctuation in the required operating force, making it particularly difficult to modulate the dispensing nozzle at low flow rates.

It is important to be able to control the flow rate and cut-off of a fuel dispensing nozzle. As costs have increased, a penny's worth of fuel has become more and more difficult to meter, since it represents a diminishing quantity. It has thus become increasingly difficult to prevent overshooting of the desired dollar amount of a purchase. Often, a customer orders an even dollar amount of fuel and is dissatisfied with being charged for fuel in excess of that which he has ordered. A policy of forgiving the charge of a few extra cents to a customer is undesirable since the accumulation of a few cents for many customers can amount to a significant dollar loss. Moreover, a system which must tolerate such shortages also has the potential for employee fraud.

The difficulties involved in the use of a dispensing nozzle outlined above are particularly acute in self-service gasoline stations. In self-service installations, the general patronage will contain people of widely differing motor skills, dexterity, grip, and familiarity with dispensing equipment.

SUMMARY OF THE INVENTION

The invention provides a dispenser nozzle particularly suited for metered fuel delivery having a mechanical actuation which increases the degree of control and reduces the requisite actuation force at zero or low flow rates. More particularly, the dispenser nozzle constructed in accordance with the invention has means in its actuating system to tilt a valve poppet on its seat in response to displacement of a control lever squeezed by the hand of the user. The force necessary to open or "crack" the poppet is thus reduced to nearly half that required in similar prior art designs. As a result, people with even limited hand strength can comfortably operate the dispenser nozzle. Controllability of the nozzle is also enhanced by the tilting poppet because, during initial valve movement, displacement of the hand lever is, in effect, proportionately reduced so that greater precision in flow control is achieved. Thus, the requisite level of motor skill which must be exercised is lowered.

In accordance with an important aspect of the invention, the valve actuator elements are arranged to transform actuation from tilting motion of the poppet to full translation of the poppet throughout the mid and full range of poppet opening movement to assure complete valve opening and high flow rates with a convenient hand lever stroke and comfortable feel.

As will be apparent from the disclosure hereinbelow, the invention is adaptable to standard fuel dispenser nozzle designs. Components embodying features of the invention can be retrofitted to existing dispenser nozzle hardware. This retrofitting procedure can be accomplished when an existing nozzle is routinely serviced or rebuilt.

DETAILED DESCRIPTION OF THE PREFERRED EMBODIMENT

Figure 1:
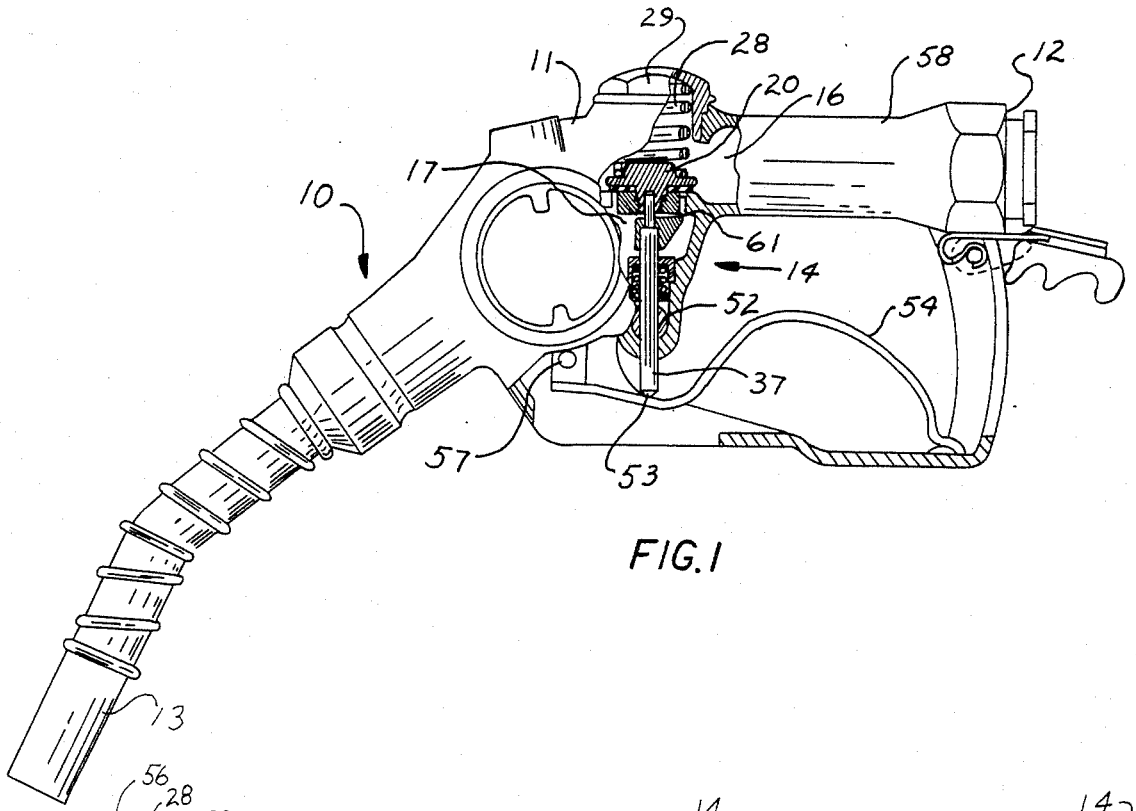
FIG. 1 is a side elevational view of a dispenser nozzle with a portion broken away and in section illustrating internal valve and actuator elements.
Figure 2A:
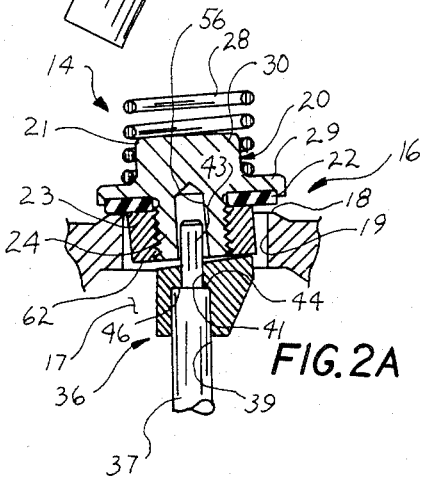
FIG. 2A is an enlarged, fragmentary, cross sectional view of one embodiment of a poppet valve and related actuator means in a slightly opened, low-flow state.
Figure 2B:
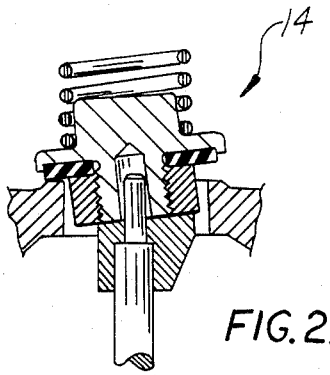
FIG. 2B is a view similar to FIG. 2A but in a progressively more opened state.
Figure 2C:
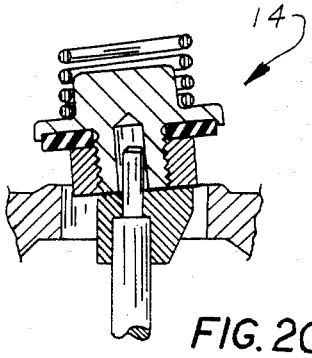
FIG. 2C is a view similar to FIG. 2A but with the valve in a fully opened state.
Figure 3:
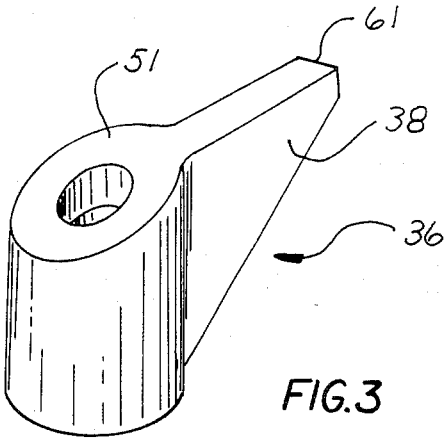
FIG. 3 is a perspective view, on a somewhat enlarged scale, of an actuator element shown in FIGS. 2A and 2B.

Referring now to the drawings, and in particular to FIGS. 1 through 3, there is shown a fuel dispenser nozzle 10. The nozzle 10 includes a housing 11 adapted to be connected at one end 12 to a flexible fuel supply hose and having at an opposite end a spout 13 for delivering fuel into a container such as the fuel storage tank of a motor vehicle. The general arrangement of the nozzle 10, with the exception of those parts described in detail below, can be, for example, the same or essentially the same as that disclosed in U.S. Pat. No. 3,062,247, the disclosure of which is incorporated herein by reference.

Flow of fuel through the nozzle housing 11 is controlled by a valve section 14 disposed between inlet and outlet passages 16, 17, respectively. The valve section 14 includes an annular seat 18 integrally formed in the body 11 and encircling a bore 19 communicating between the inlet and outlet flow passages 16, 17.

On the inlet side of the annular seat 18 (FIGS. 2A, 2B, and 2C) is a circular poppet 20. The poppet 20 is an assembly of a circular basket 21, an elastomeric sealing disc 22, and a retaining nut 23. The sealing disc 22 is provided with a central aperture in the manner of a washer, and is piloted on a threaded boss 24 of the basket 21. The nut 23 is threaded on the boss 24 to retain the sealing disc 22 thereon. The major diameter of the disc 22 exceeds that of the annular seat 18, permitting it to seal the seat and thereby control fluid flow therethrough.

The poppet 20 is resiliently biased to a closed position on the seat 18 by a compression spring 28 bearing on a circular peripheral basket flange 29 on a side thereof opposite the seal disc 22. The spring 28 is concentrically disposed about a head section 30 of the basket body 21.

Below the seat 18 in the outlet flow passage 17 is a poppet lifter actuator 36 assembled on the end of an actuator rod 37. The lifter 36, which is shown on an enlarged scale in FIG. 3, is a generally cylindrical body having an integral triangular arm 38 extending radially from one side. A central bore 39 and counterbore 41 are respectively sized to slip onto the cylindrical actuator rod 37 and a reduced diameter stem section 43 of such rod. A radial shoulder 44 on the actuator rod 37 bears against an internal radial face 46 in the lifter 36, enabling the actuator rod 37 to transfer axially directed forces to the lifter. A planar face 51 on an upper side of the lifter 36 is formed across both the cylindrical section and triangular arm section 38 of the lifter. This face 51 is oblique to the longitudinal axis of the actuator rod 37, as well as the axis of the plane of the circular seat 18 and makes an angle of about 5° with the plane of the seat 18. Suitable angles are in the range of 3° to 25°, and preferably about 5° to 10°. The actuator rod 37 is guided for axial displacement and is sealed by a packing 52 in the housing body 11, in accordance with conventional practice. The axis of the actuator rod 37 is coincident with the axis of the annular valve seat 18. An end 53 of the actuator rod or stem 37 projects out of the housing body 11 and is engaged by a hand lever 54. The reduced diameter extension 43 of the actuator rod 37 is received in a blind clearance bore 56 centrally disposed on the lower side or face of the poppet basket boss 24. The fit between this actuator rod extension 43 and blind bore 56 is sufficiently loose to allow tilting of the poppet 20, as described below, but is close enough to adequately center the poppet on the seat 18.

At one end, the hand lever 54 is pivoted on a pin or fulcrum 57. The pin 57 may be held in position by an automatic shut-off device, such as that disclosed in the aforementioned U.S. Pat. No. 3,062,247. On a side of the actuator rod 37 opposite the pivot pin 57, a main length of the lever 54 provides a finger grip for a person's hand when the palm of the latter is wrapped about a cylindrical portion 58 of the housing body 11 enclosing the inlet passage 16.

In operation of the dispenser nozzle 10, flow of fluid such as gasoline or other liquid fuel enters the inlet passage 16 from a flexible hose (not shown). Under control of the valve poppet 20, this fluid is allowed to travel through the valve bore 19 into the outlet passage 17 and ultimately to the spout 13. The poppet 20 is displaced from the closed position illustrated in FIG. 1, where it is in sealing engagement with the full circumference of the annular seat 18, to a partially open condition by initial axial displacement of the actuator rod 37. Such movement of the rod 37 is manually effected by pivoting the lever 54 towards the cylindrical casing section 58 by squeezing such lever with one's fingers.

As indicated in FIG. 1, at the initial stage of contact, a distal end 61 of the lifter arm 38 eccentrically contacts a radially outward point on a lower face 62 of the poppet retaining nut 23. As shown in FIG. 2A, continued axial displacement of the actuator rod 37 causes the poppet 20 to tilt or rock on the seat 18 at a point diametrically opposite to the point of contact of the distal end 61 of the lifter arm 38. In this partially tilted condition of the poppet an exceptionally high degree of flow control at relatively low flow rates is achieved. Further movement of the actuator rod 37 causes progressive tilting of the poppet 20 at an increasing angle with reference to the plane of the seat 18.

Eventually, the tilt angle of the poppet 20 assumes the angle of the plane of the lifter face 51, the condition illustrated in FIG. 2B. Thereafter, as depicted in FIG. 2C continued axial displacement of the actuator rod 37 causes the poppet 20 to lift away from the annular seat 18 in translation, i.e., without further tilting action thereby affording a relatively large valve opening rate for a given displacement of the hand lever 54.

Greater control is achieved because the total area of the flow path between the poppet 20 and seat 18 for a given axial displacement of the actuator rod 37 is substantially less than when the entire poppet was lifted the same distance.

Controllability is also enhanced when the poppet 20 is tilted because the effort required to crack the poppet is substantially below that which would be required to lift the full poppet axially against the fuel supply pressure and spring 28 in translation from the valve seat 18. The reduction in operating force when the poppet is tilted is explained by a static force analysis on the poppet. A portion of the force developed by the fluid pressure and spring force tending to close the poppet 20 is taken by the limited contact area of the seat upon or about which the poppet is being tilted or rocked. The load to balance the valve-closing force is shared by the valve seat 18 and the actuator rod 37. The hand lever 54 only has to overcome the reduced load on the actuator rod 37. A reduction in operating force required to overcome the forces operating on the closed poppet is proportional to the eccentricity of the point from the center axis of the poppet at which an axial force is applied by the lifter. It is preferred that the peripheral portion of the poppet 20 be contacted by the lifter or actuating means in order to take full advantage of this relationship.

The kinematics of the disclosed valve structure can be described as a double lever system, with the hand lever 54 and pivot pin 57 comprising the lever and fulcrum of the first lever system and the poppet and area of the valve seat on which the poppet tilts diametrically opposed to the lifter point 61 forming, respectively, the lever and fulcrum of the second lever system. The actuator rod 37 forms the mechanical link between these lever systems. By compounding these lever systems, as disclosed, a high mechanical advantage is afforded and the manual effort required to displace the hand lever is significantly reduced.

A flow control valve such as shown in FIGS. 1–3 was comparison-tested against three commercially available competitive nozzle designs. At the minimum controllable flow rate when the supply pressure was a normal 27 psi, the valve of the invention delivered 0.1 gal/min versus 2.25 gal/min for the best of the three commercial units tested. The valve of the invention thus provided a 22 times lower flow rate than the next best unit. At $1.50 per gallon, the valve of the invention can dispense a penny's worth of gasoline in as long as four seconds, whereas, the next best nozzle dispenses a penny's worth in less than 1/5 second. A service station can save the price of the nozzle valve in a few weeks by eliminating overfills beyond the amount ordered by the customer.

Referring in general to FIGS. 4 through 9, there are shown several additional embodiments of the invention. In these various figures, like or analogous elements are identified with like numerals distinguished by an individual suffix letter.

Figure 4:
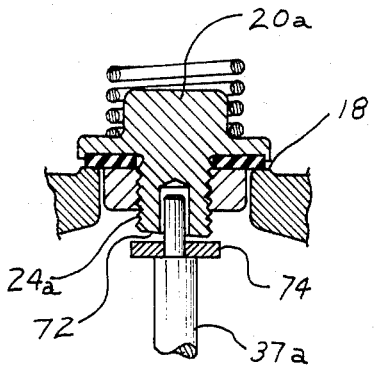
FIG. 4 is a fragmentary, cross sectional view of a second embodiment of a poppet control valve.

Referring now to FIG. 4, a flat washer 74, fixed to an actuator rod 37*a* by a press fit or other means, is caused to bear upwardly at a force point eccentric to the poppet axis at the lowermost portion of the edge of an oblique plane surface 72 formed on the lower side of a poppet basket boss 24*a*. The poppet, like the embodiment of FIGS. 1–3, is centered on the seat 18 by an extension of the actuator rod 37*a*.

Figure 5:
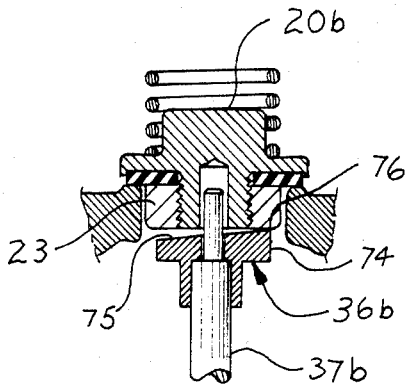
FIG. 5 is a fragmentary, cross sectional view of another embodiment of a poppet control valve.

In the embodiment of FIG. 5, a lifter 36*b* includes an integral, circumferentially continuous disc 74 on its upper end. A face 75 of a disc is oblique to the axis of the actuator rod 37*b* and seat 18 so that upon initial contact with the poppet nut 23, the latter is engaged at a point 76 which is eccentric to the axis of the poppet 20*b*. Again, the poppet 20*b*, like the earlier-described embodiments, is centered on the seat 18 by an extension of the actuator rod 37*b*.

Figure 6:
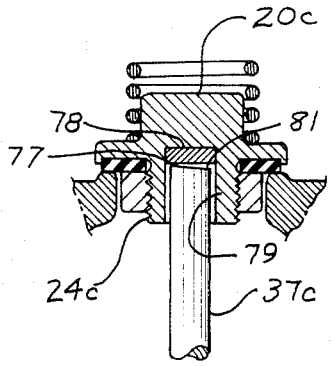
FIG. 6 is a fragmentary, cross sectional view of an additional embodiment of a poppet control valve.

In the embodiment illustrated in FIG. 6, the poppet 20*c* is eccentrically lifted to effect tilting action thereof by contact of an edge 77 of the actuator rod 37*c*, with an insert disc 78 pressed or otherwise retained in a blind bore 79 concentrially disposed in the poppet bonnet boss 24*c*. The edge 77 is formed by the intersection of an oblique end face 81 with the cylindrical sidewall surface of the actuator rod 37*c*. In this arrangement, the poppet 20*c* is centered by the full diameter of the actuator rod 37*c*, which is received in the bore 79.

Figure 7:
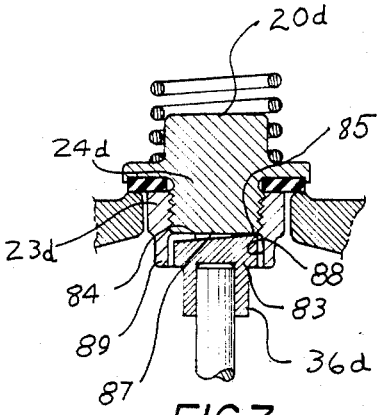
FIG. 7 is a fragmentary, cross sectional view of a poppet control valve in accordance with yet another embodiment of the invention.

In FIG. 7, the lifter 36*d* is formed with a circular disc 83 at its upper end. An end face 84 of the lifter disc 83 lies in an oblique plane such that at one side 85 the edge of this face 84 eccentrically contacts the end face 87 of the poppet basket boss 24*d*. In this arrangement, the poppet 20*d* is centered by the lifter disc 83, which fits loosely into a bore 88 formed by a skirt 89 of a retaining nut 23*d*.

Figure 8:
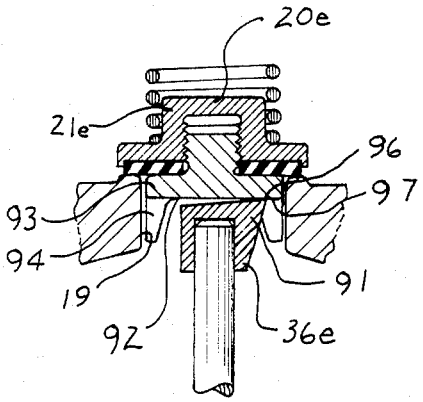
FIG. 8 is a fragmentary, cross-sectional view of a poppet control valve in accordance with still another embodiment of the invention.

With reference to FIG. 8, an asymmetrical lifter 36*e* having an eccentric arm 91 similar to that of the lifter 36 of FIGS. 1–3 operates on a face 92 of a retainer 93. The retainer 93, which is threaded into a poppet basket 21*e*, includes spiderlike circumferentially spaced lugs 94 which loosely engage the seat bore 19 to center the poppet 20*e* while allowing it to tilt. The poppet 20*e* is caused to tilt by an eccentric force developed by engagement of a point 96 at the distal end of the eccentric lifter arm 91 which engages a downwardly facing surface 97 on the retainer 93.

Figure 9:
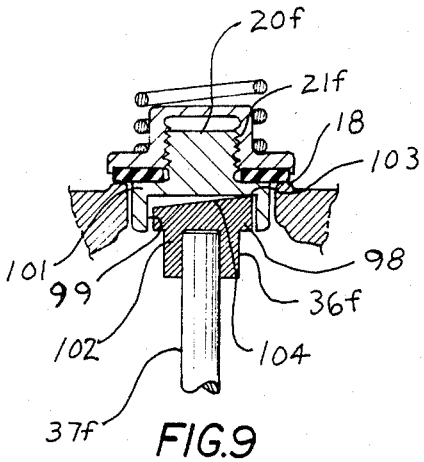
FIG. 9 is a fragmentary, cross sectional view of a poppet control valve in a further embodiment of the invention.

In FIG. 9, an embodiment of the invention includes a lifter 36*f* having a disc portion 98 received in a shallow central bore 99 in a retainer 101. The retainer 101 is threaded into a poppet basket 21*f*. The disc portion 98 includes an oblique face 102 at its upper side. An edge 103 of the face 102 contacts an end wall 104 of the shallow bore 99 eccentrically of the axis of the poppet 20*f* so that, upon lifting of the actuator rod 37*f*, the poppet 20*f* is caused to initially tilt on the seat 18.

In all of the foregoing exemplary embodiments of the invention, the various poppet and actuator elements are arranged to cause the poppet, in initial opening movement, to tilt on its seat. The poppet is tilted open to a moderate angle determined by an oblique angle of, for example, 5 degrees formed by an actuator lifting surface or a poppet surface confronting such actuator lifting surface. Thereafter, continued opening movement of the poppet from the seat is translational, so that fast valve opening is achieved.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In a fuel dispensing nozzle including a housing, means for coupling the housing to a flexible delivery hose, an outlet spout, valve means in the housing for controlling flow from the delivery hose to the outlet spout, said valve means including a poppet and a cooperating seat, a hand lever for manually operating said control valve, the improvement comprising means responsive to movement of the hand lever to tilt open the poppet so that the poppet rocks about a point on its periphery and the forces required to crack open the valve are reduced, said poppet tilting means including means to apply a generally axially directed opening force to said poppet at a point eccentric to its central axis, said poppet tilting means including an actuator rod centered on the axis of said valve seat and disposed between said hand lever and said poppet, and a lifter carried on an end of said actuator rod adjacent said poppet, said lifter and poppet including opposed flat contacting surfaces, one of said flat contacting surfaces being disposed in a plane oblique to the axis of said seat when said poppet is in a closed position on said seat, said opposed flat surfaces being arranged to tilt said poppet to an angle of less than 25° and thereafter upon full abutting contact between said oblique flat surface and the opposed flat surface and further lever movement to cause said poppet to translate in straight-line motion without further tilting action away from said seat, and means for centering said poppet on said seat, said centering means including surface areas contacting said poppet, said surface areas and poppet being sufficiently loose with respect to one another to permit initial tilting of said poppet to said angle but close enough with respect to one another to thereafter restrain said poppet from moving laterally relative to said seat during straight-line translating motion.

2. In a fuel dispensing nozzle having a housing body enclosing inlet and outlet flow passages, an annular seat surrounding a bore communicating between said passages, a circular poppet at least partially disposed in said inlet passage and cooperating with said annular seat to close off fluid flow between said passages, a lever pivotally supported at one end by pivot means carried on the housing body, an end of said lever disposed externally of said housing body being hand manipulable, actuator means operatively connecting said hand lever to said poppet, said poppet including a flat surface, said actuator means including a flat surface engageable with said flat poppet surface upon manipulation of said lever, one of said flat surfaces being oblique to the axis of said seat when said poppet is in its closed position, the initially contacting surfaces of said actuator means and poppet being constructed and arranged to produce, primarily by axially directed forces, opening movement of said poppet by tilting of said poppet on said seat during initial manipulative movement of said hand lever, said one flat surface defining a plane on which said poppet is supported in a tilted condition for subsequent progressive opening movement in translation of said poppet in straight-line motion without further tilting motion during subsequent progressive movement of said hand lever, and means for centering said poppet on said seat, said centering means including surface areas contacting said poppet, said surface areas and poppet being sufficiently loose with respect to one another to permit initial tilting of said poppet but close enough with respect to one another to thereafter restrain said poppet from moving laterally relative to said seat during straight-line translating motion, the initial tilting movement of said poppet reducing the manual effort to initially crack said poppet and providing a greater degree of flow control than is experienced by subsequent translation of said poppet per unit of lever displacement.

* * * * *